US012123131B2

(12) United States Patent
Oshima et al.

(10) Patent No.: US 12,123,131 B2
(45) Date of Patent: Oct. 22, 2024

(54) SYNTHETIC FIBER PROCESSING AGENT AND SYNTHETIC FIBER

(71) Applicant: TAKEMOTO YUSHI KABUSHIKI KAISHA, Aichi-ken (JP)

(72) Inventors: Keiichiro Oshima, Gamagori (JP); Satoru Hamajima, Gamagori (JP); Jun Ito, Gamagori (JP)

(73) Assignee: TAKEMOTO YUSHI KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 18/565,869

(22) PCT Filed: Jun. 2, 2022

(86) PCT No.: PCT/JP2022/022415

§ 371 (c)(1),
(2) Date: Nov. 30, 2023

(87) PCT Pub. No.: WO2022/255433

PCT Pub. Date: Dec. 8, 2022

(65) Prior Publication Data

US 2024/0271360 A1 Aug. 15, 2024

(30) Foreign Application Priority Data

Jun. 4, 2021 (JP) ..... 2021-094519

(51) Int. Cl.

| | |
|---|---|
| ***D06M 13/328*** | (2006.01) |
| ***D06M 13/11*** | (2006.01) |
| ***D06M 13/165*** | (2006.01) |
| ***D06M 15/643*** | (2006.01) |
| ***D06M 101/40*** | (2006.01) |

(52) U.S. Cl.

CPC ..... *D06M 13/328* (2013.01); *D06M 13/11* (2013.01); *D06M 13/165* (2013.01); *D06M 15/643* (2013.01); *D06M 15/6436* (2013.01); *D06M 2101/40* (2013.01); *D06M 2200/30* (2013.01)

(58) Field of Classification Search

CPC combination set(s) only.
See application file for complete search history.

(56) References Cited

U.S. PATENT DOCUMENTS

2008/0009428 A1 1/2008 Svarcas et al.

FOREIGN PATENT DOCUMENTS

| | | | |
|---|---|---|---|
| CN | 102899900 | A | 1/2013 |
| CN | 105734977 | A | 7/2016 |
| JP | 2000-063490 | A | 2/2000 |
| JP | 2008-505219 | A | 2/2008 |
| JP | 2010-534736 | A | 11/2010 |
| JP | 2015-094039 | A | 5/2015 |
| JP | 2021-011653 | A | 2/2021 |
| JP | 2021-014656 | A | 2/2021 |
| WO | WO 2009/016400 | A1 | 2/2009 |
| WO | WO 2018/003347 | A1 | 1/2018 |

OTHER PUBLICATIONS

International Search Report and Written Opinion mailed Jul. 5, 2022, in connection with International Application No. PCT/JP2022/022415.

Japanese Office Action issued on Aug. 17, 2021, in the corresponding Japanese Patent Application No. 2021-094519 (with English Translation).

*Primary Examiner* — Lynda Salvatore

(74) *Attorney, Agent, or Firm* — Wolf, Greenfield & Sacks, P.C.

(57) ABSTRACT

Disclosed is a synthetic fiber treatment agent containing a phenol amine compound and a nonionic surfactant. The phenol amine compound is at least one selected from the group consisting of a compound formed from a phenol derivative, formaldehyde, and a polyamine compound and a compound obtained by reacting a boron-containing compound with a compound formed from a phenol derivative, formaldehyde, and a polyamine compound. The phenol derivative is a phenol in which a hydrocarbon group with a number average molecular weight of not less than 100 and not more than 2000 is modified.

9 Claims, No Drawings

SYNTHETIC FIBER PROCESSING AGENT AND SYNTHETIC FIBER

CROSS REFERENCE TO RELATED APPLICATIONS

This Application is a national stage filing under 35 U.S.C. 371 of International Patent Application Serial No PCT/JP2022/022415, filed Jun. 2, 2022, which claims priority to Japanese application number 2021-094519 filed, Jun. 4, 2021. The entire contents of these applications are incorporated herein by reference in their entirety.

TECHNICAL FIELD

The present invention relates to a synthetic fiber treatment agent and to a synthetic fiber.

BACKGROUND ART

Carbon fibers are produced, for example, by performing a spinning step of spinning an acrylic resin or the like into fibers, a dry densification step of drying and densifying the spun fibers, a drawing step of drawing the dry densified fibers to produce a carbon fiber precursor, which is synthetic fibers, a flame-resisting processing step of making the carbon fiber precursor flame-resistant, and a carbonization step of carbonizing the flame-resistant fibers.

A synthetic fiber treatment agent may be used in the process of producing the synthetic fibers to improve the bundling property of fibers.

Patent Document 1 discloses a fiber treatment agent as a synthetic fiber treatment agent that contains an amino-modified silicone, a surfactant, and an amine compound having a polyoxyalkylene group and two or more primary amine groups in the molecule.

CITATION LIST

Patent Literature

Patent Document 1: International Publication No. WO 2018/003347

SUMMARY OF INVENTION

Technical Problem

Improvement of the bundling property of flame-resistant fibers obtained by making synthetic fibers flame-resistant and suppression of fluffing of carbon fibers obtained by carbonizing the flame-resistant fibers are also being demanded of a synthetic fiber treatment agent.

The present invention has been made in view of such circumstances and an object thereof is to provide a synthetic fiber treatment agent that enables improvement of the bundling property of flame-resistant fibers and suppression of fluffing of carbon fibers. It is also an object of the present invention to provide a synthetic fiber to which this synthetic fiber treatment agent is adhered.

Solution to Problem

A synthetic fiber treatment agent for solving the above problem contains a phenol amine compound and a nonionic surfactant.

The phenol amine compound is at least one selected from the group consisting of a compound formed from a phenol derivative, formaldehyde, and a polyamine compound and a compound obtained by reacting a boron-containing compound with a compound formed from a phenol derivative, formaldehyde, and a polyamine compound. The phenol derivative is a phenol in which a hydrocarbon group with a number average molecular weight of not less than 100 and not more than 2000 is modified.

In the synthetic fiber treatment agent, the nonionic surfactant preferably includes at least one selected from the group consisting of a compound in which an alkylene oxide with not less than 2 and not more than 4 carbon atoms is added at a ratio of not less than 1 mole and not more than 50 moles in total to 1 mole of a monohydric alcohol with not less than 4 and not more than 30 carbon atoms and a compound in which an alkylene oxide with not less than 2 and not more than 4 carbon atoms is added at a ratio of not less than 1 mole and not more than 50 moles in total to 1 mole of an alkylamine with not less than 4 and not more than 30 carbon atoms.

In the synthetic fiber treatment agent, the mass ratio of the phenol amine compound and the nonionic surfactant is preferably such that phenol amine compound/nonionic surfactant is not less than 5/95 and not more than 95/5.

The synthetic fiber treatment agent preferably further contains a Broensted acid.

The synthetic fiber treatment agent preferably further contains an epoxy compound.

In the synthetic fiber treatment agent, the epoxy compound preferably includes at least one selected from the group consisting of an epoxy-modified silicone and an epoxy and polyether-modified silicone.

The synthetic fiber treatment agent preferably further contains at least one selected from the group consisting of an amino-modified silicone, a dimethyl silicone, and a polyether-modified silicone.

In the synthetic fiber treatment agent, the synthetic fiber is preferably a carbon fiber precursor.

A synthetic fiber treatment agent for solving the above problem has the synthetic fiber treatment agent adhered thereto.

Advantageous Effects of Invention

The present invention succeeds in improving the bundling property of flame-resistant fibers and suppressing fluffing of carbon fibers.

DESCRIPTION OF EMBODIMENTS

First Embodiment

A first embodiment in which a synthetic fiber treatment agent according to the present invention (also simply referred to hereinafter as treatment agent) is embodied will now be described.

The treatment agent of the present embodiment contains a phenol amine compound and a nonionic surfactant.

By the treatment agent containing the phenol amine compound and the nonionic surfactant, when synthetic fibers with the treatment agent adhered thereto are subject to flame-resisting processing, the bundling property of the flame-resistant fibers can be improved. Also, when the flame-resistant fibers are carbonized, fluffing of the carbon fibers can be suppressed.

<Phenol Amine Compound>

The phenol amine compound is preferably at least one selected from among a compound formed from a phenol derivative, formaldehyde, and a polyamine compound and a compound obtained by reacting a boron-containing compound with a compound formed from a phenol derivative, formaldehyde, and a polyamine compound. The phenol derivative is a phenol in which a hydrocarbon group with a number average molecular weight of not less than 100 and not more than 2000 is modified. The phenol derivative is preferably represented by Chemical Formula 1 shown below.

[Chemical Formula 1]

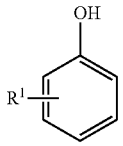

In Chemical Formula 1, $R^1$ is a hydrocarbon group with a number average molecular weight of not less than 100 and not more than 2000. The hydrocarbon group with a number average molecular weight of not less than 100 and not more than 2000 is not particularly limited, and examples thereof include a hydrocarbon group constituted of a polymer of, for example, propene, butene, pentene, hexene, octene, isobutene, isopentane, isohexene, or isooctene.

The number average molecular weight is preferably not less than 500 and not more than 1800 and more preferably not less than 600 and not more than 1500.

Only one $R^1$ may modify the phenol, or two or more $R^1$ may modify the phenol. That is, the phenol derivative can be a modified phenol that is modified by one or more hydrocarbon carbon groups. When the phenol is modified by two or more hydrocarbon groups, the two or more hydrocarbon groups may be of the same type as each other or may be of different types. The phenol derivative may have a functional group such as a hydrocarbon group other than $R^1$ as long as it has the basic structure of phenol.

The polyamine compound means an aliphatic hydrocarbon with two or more primary amino groups bonded thereto. The polyamine compound is preferably represented by Chemical Formula 2 shown below.

$$H_2N(CH_2CH_2NH)xCH_2CH_2NH_2$$ [Chemical Formula 2]

In Chemical Formula 2, X is an integer not less than 0 and not more than 10.

The polyamine compound is not particularly limited, and specific examples thereof include ethylenediamine, diethylenetriamine, dipropylenetriamine, dibutylenetriamine, triethylenetetramine, tripropylenetetramine, tributylenetetramine, tetraethylenepentamine, tetrapropylenepentamine, and tetrabutylenepentamine.

One type of the polyamine compound may be used alone or two or more types may be used in combination.

The phenol amine compound is preferably formed by a Mannich reaction of the phenol derivative, formaldehyde, and polyamine compound.

The phenol amine compound is preferably represented by Chemical Formula 3 or 4 shown below.

[Chemical Formula 3]

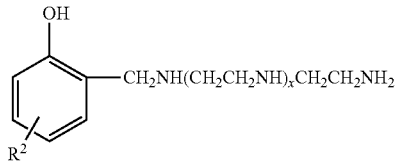

In Chemical Formula 3, $R^2$ is a hydrocarbon group with a number average molecular weight of not less than 100 and not more than 2000, and X is an integer not less than 0 and not more than 10.

[Chemical Formula 4]

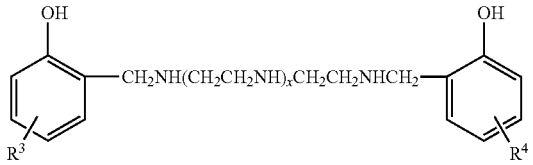

In Chemical Formula 4, $R^3$ is a hydrocarbon group with a number average molecular weight of not less than 100 and not more than 2000, $R^4$ is a hydrocarbon group with a number average molecular weight of not less than 100 and not more than 2000, and X is an integer not less than 0 and not more than 10.

The phenol amine compound may include one of the compounds of Chemical Formulae 3 and 4 or may include both the compounds of Chemical Formulae 3 and 4. That is, the phenol amine compound may be a mixture of the compounds of Chemical Formulae 3 and 4.

Alternatively, the phenol amine compound may be a compound obtained by reacting a boron-containing compound with a compound formed from the phenol derivative, formaldehyde, and polyamine compound. For example, the phenol amine compound may be a compound obtained by reacting a boron-containing compound with the compound of Chemical Formula 3 or 4.

In other words, the phenol amine compound may be a borylated phenol amine compound. Alternatively, the phenol amine compound may be a mixture of a non-borylated phenol amine compound, such as the compound of Chemical Formula 3 or 4, and a borylated phenol amine compound.

The boron-containing compound is not particularly limited, and examples thereof include boron oxide, halogenated boron, boric acid, boric anhydride, and boric acid ester.

One type of the above boron-containing compound may be used alone or two or more types may be used in combination.

The ratio of the phenol derivative, formaldehyde, and polyamine compound in forming the phenol amine compound is not particularly limited, and the forming can be performed upon adjusting the ratio as appropriate. The ratio of the phenol derivative, formaldehyde, and polyamine compound is preferably such that not less than 0.7 equivalents and not more than 3.5 equivalents of formaldehyde and not less than 0.3 equivalents and not more than 1.5 equivalents of the polyamine compound are reacted with 1 equivalent of the phenol derivative.

If the phenol amine compound is a compound obtained by reacting the boron-containing compound with the compound formed from the phenol derivative, formaldehyde, and polyamine compound, the ratio of the boron-containing compound is not particularly limited, and the reaction can be performed upon adjusting the ratio as appropriate. Regarding the ratio of the boron-containing compound, the boron-containing compound is preferably reacted with the phenol amine compound such that the boron content is not less than 0.05% by mass and not more than 1.5% by mass.

The compound of the above Chemical Formula 3 or 4 as the phenol amine compound or that obtained by reaction with the boron-containing compound can be identified, for example, by liquid chromatography mass spectrometry (LC-MS).

<Diluent>

The phenol amine compound is preferably used as a solution diluted by a diluent in mixing with a nonionic surfactant, etc., to prepare the treatment agent as described below.

Examples of the diluent include water, an organic solvent, and a mineral oil. Examples of the organic solvent include hexane, ethanol, isopropanol, ethylene glycol, propylene glycol, diethyl ether, toluene, xylene, dimethylformamide, methyl ethyl ketone, and chloroform. Examples of the mineral oil include an aromatic hydrocarbon, a paraffin hydrocarbon, and a naphthene hydrocarbon. More specific examples thereof include spindle oil and liquid paraffin. The viscosity of the mineral oil is preferably 80 to 190 Redwood seconds. As the mineral oils, a commercial product may be used as appropriate.

There are no limits in content ratios of the phenol amine compound and the diluent in the treatment agent. If the sum of the contents of the phenol amine compound and the diluent in the treatment agent is taken as 100% by mass, the treatment agent preferably contains the phenol amine compound at a ratio of not less than 30% by mass and not more than 90% by mass and the diluent at a ratio of not less than 10% by mass and not more than 70% by mass and more preferably contains the phenol amine compound at a ratio of not less than 40% by mass and not more than 80% by mass and the diluent at a ratio of not less than 20% by mass and not more than 60% by mass.

<Nonionic Surfactant>

The nonionic surfactant is not particularly limited and preferably includes at least one selected from the group consisting of a compound in which an alkylene oxide with not less than 2 and not more than 4 carbon atoms is added at a ratio of not less than 1 mole and not more than 50 moles in total to 1 mole of a monohydric alcohol with not less than 4 and not more than 30 carbon atoms and a compound in which an alkylene oxide with not less than 2 and not more than 4 carbon atoms is added at a ratio of not less than 1 mole and not more than 50 moles in total to 1 mole of an alkylamine with not less than 4 and not more than 30 carbon atoms.

The monohydric alcohol with not less than 4 and not more than 30 carbon atoms may be an aliphatic alcohol with a straight chain or branched chain structure or may be an aromatic alcohol. It may also be any of a primary alcohol, secondary alcohol, or tertiary alcohol.

Specific examples of the monohydric alcohol with not less than 4 and not more than 30 carbon atoms include (1) straight-chain alkyl alcohols, such as butanol, pentanol, hexanol, octanol, nonanol, decanol, undecanol, dodecanol, tridecanol, tetradecanol, pentadecanol, hexadecanol, heptadecanol, octadecanol, nonadecanol, eicosanol, heneicosanol, docosanol, tricosanol, tetracosanol, pentacosanol, hexacosanol, heptacosanol, octacosanol, nonacosanol, and triacontanol, (2) branched alkyl alcohols, such as isobutanol, isohexanol, 2-ethylhexanol, isononanol, isodecanol, isododecanol, isotridecanol, isotetradecanol, isotriacontanol, isohexadecanol, isoheptadecanol, isooctadecanol, isononadecanol, isoeicosanol, isoheneicosanol, isodocosanol, isotricosanol, isotetracosanol, isopentacosanol, isohexacosanol, isoheptacosanol, isooctacosanol, isononacosanol, and isopentadecanol, (3) straight-chain alkenyl alcohols, such as tetradecenol, hexadecenol, heptadecenol, octadecenol, and nonadecenol, (4) branched alkenyl alcohols, such as isohexadecenol and isooctadecenol, (5) cyclic alkyl alcohols, such as cyclopentanol and cyclohexanol, and (6) aromatic alcohols, such as phenol, nonylphenol, benzyl alcohol, monostyrenated phenol, distyrenated phenol, and tristyrenated phenol.

The alkylamine with not less than 4 and not more than 30 carbon atoms is not particularly limited and may be any of a primary amine, secondary amine, or tertiary amine.

An alkyl group with not less than 4 and not more than 30 carbon atoms in the alkylamine with not less than 4 and not more than 30 carbon atoms may be an alky group with a straight or branched chain. It may also be a saturated alkyl group or an unsaturated alkyl group.

Specific examples of the straight chain alkyl group include a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, and an icosyl group.

Specific examples of the saturated alkyl group with a branched chain include an isobutyl group, an isopentyl group, an isohexyl group, an isoheptyl group, an isooctyl group, an isononyl group, an isodecyl group, an isoundecyl group, an isododecyl group, an isotridecyl group, an isotetradecyl group, an isopentadecyl group, an isohexadecyl group, an isoheptadecyl group, an isooctadecyl group, and an isoicosyl group.

The unsaturated alkyl group may be an alkenyl group having one double bond as an unsaturated carbon bond or may be an alkadienyl group or an alkatrienyl group having two or more double bonds. It may also be an alkynyl group having one triple bond as an unsaturated carbon bond or may be an alkadiynyl group having two or more triple bonds. Specific examples of the unsaturated straight chain alkyl group having one double bond in the hydrocarbon group include an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, and an icosenyl group.

Specific examples of the unsaturated alkyl group with a branched chain having one double bond in the alkyl group include an isooctenyl group, an isononenyl group, an isodecenyl group, an isoundecenyl group, an isododecenyl group, an isotridecenyl group, an isotetradecenyl group, an isopentadecenyl group, an isohexadecenyl group, an isoheptadecenyl group, an isooctadecenyl group, and an isoicosenyl group.

Examples of the alkylene oxide with not less than 2 and not more than 4 carbon atoms include ethylene oxide, propylene oxide, and butylene oxide. Among these, it is preferable for ethylene oxide to be contained.

The polymerization sequence of the alkylene oxide is not particularly limited and may be of a random adduct or a block adduct.

One type of the alkylene oxide with not less than 2 and not more than 4 carbon atoms may be used alone or two or more types may be used in combination.

The number of moles of the alkylene oxide added represents the number of moles of the alkylene oxide with respect to 1 mole of the alcohol in charged raw materials.

The mass ratio of the phenol amine compound and the nonionic surfactant is not particularly limited, and preferably, phenol amine compound/nonionic surfactant is not less than 5/95 and not more than 95/5.

<Broensted Acid>

The treatment agent of the present embodiment preferably further contains a Broensted acid.

By containing a Broensted acid, the bundling property of the flame-resistant fibers can be further improved.

A Broensted acid means an acid that has a proton and can release or dissociate the proton in a liquid composition containing water. The Broensted acid differs from an acid that does not have a proton, such as a Lewis acid.

The Broensted acid is not particularly limited, and specific examples thereof include acetic acid; alkyl ether acetic acids, such as polyoxyethylene (n=10) lauryl ether acetic acid and polyoxyethylene (n=4.5) lauryl ether acetic acid; oleoyl sarcosinate; lauroyl sarcosinate; phosphoric acid esters, such as phosphoric acid ester of a 5 mole ethylene oxide adduct of tridecyl alcohol and hexadecyl phosphoric acid ester; lactic acid; citric acid; phosphoric acid; alkylbenzene sulfonic acids, such as dodecyl benzenesulfonic acid; and sulfuric acid.

One type of the Broensted acid may be used alone or two or more types may be used in combination.

The content of the Broensted acid in the treatment agent is not particularly limited and is preferably not less than 0.01% by mass and not more than 10% by mass and more preferably not less than 0.1% by mass and not more than 5% by mass.

<Epoxy Compound>

The treatment agent of the present embodiment preferably further contains an epoxy compound.

By containing an epoxy compound, fluffing of carbon fibers can be suitably suppressed when producing the carbon fibers using synthetic fibers with the treatment agent adhered thereto.

The epoxy compound is not particularly limited and preferably includes at least one selected from among an epoxy-modified silicone and an epoxy and polyether-modified silicone.

By the epoxy compound including the at least one selected from among an epoxy-modified silicone and an epoxy and polyether-modified silicone, the fluffing of carbon fibers can be suppressed more suitably.

Specific examples of the epoxy compound include a side-chain type alicyclic epoxy-modified silicone with a kinematic viscosity at 25° C. of 6000 $mm^2/s$ and an equivalent weight of 3700 g/mol, a side-chain type glycidyl epoxy-modified silicone with a kinematic viscosity at 25° C. of 8000 $mm^2/s$ and an equivalent weight of 3300 g/mol, a dual-end type glycidyl epoxy-modified silicone with a kinematic viscosity at 25° C. of 120 $mm^2/s$ and an equivalent weight of 2700 g/mol, a side-chain type glycidyl epoxy polyether-modified silicone with a kinematic viscosity at 25° C. of 2800 $mm^2/s$ and an equivalent weight of 2800 g/mol, a side-chain type alicyclic epoxy-modified silicone with a kinematic viscosity at 25° C. of 5000 $mm^2/s$ and an equivalent weight of 4200 g/mol, a side-chain type glycidyl epoxy polyether-modified silicone with a kinematic viscosity at 25° C. of 3100 $mm^2/s$ and an equivalent weight of 10200 g/mol, a bisphenol A diglycidyl ether (average molecular weight: 370), a bisphenol A diglycidyl ether (average molecular weight: 470), a bisphenol F diglycidyl ether (average molecular weight: 340), tetraglycidyl diaminodiphenylmethane, and a glycidyl-etherified product of polyglycerin (average molecular weight: 1000).

One type of the epoxy compound may be used alone or two or more types may be used in combination. The kinematic viscosity at 25° C. of the epoxy compound, can be measured by a known method using a Cannon-Fenske viscometer under a condition of 25° C.

The content of the epoxy compound in the treatment agent is not particularly limited and is preferably not less than 1% by mass and not more than 50% by mass and more preferably not less than 3% by mass and not more than 20% by mass.

<Other Silicone>

The treatment agent preferably further contains a silicone (also referred to hereinafter as "other silicone") other than the epoxy-modified silicone and epoxy and polyether-modified silicone. By containing the other silicone, the strength of carbon fibers produced using synthetic fibers with the treatment agent adhered thereto can be further improved as described later.

By the treatment agent containing the other silicone and the epoxy compound, fusion between the carbon fibers can be more suitably suppressed when producing the carbon fibers using the synthetic fibers with the treatment adhered thereto.

The other silicone is preferably at least one selected from among an amino-modified silicone, a dimethyl silicone, and a polyether-modified silicone.

Specific examples of the other silicone include an amino-modified silicone of a diamine type with a kinematic viscosity at 25° C. of 250 $mm^2/s$ and an equivalent weight of 7600 g/mol, an amino-modified silicone of a diamine type with a kinematic viscosity at 25° C. of 1300 $mm^2/s$ and an equivalent weight of 1700 g/mol, an amino-modified silicone of a monoamine type with a kinematic viscosity at 25° C. of 1700 $mm^2/s$ and an equivalent weight of 3800 g/mol, an amino-modified silicone of a diamine type with a kinematic viscosity at 25° C. of 80 $mm^2/s$ and an equivalent weight of 4000 g/mol, a dimethyl silicone with a kinematic viscosity at 25° C. of 5000 $mm^2/s$, and a polyether-modified silicone with a kinematic viscosity at 25° C. of 1700 $mm^2/s$, ethylene oxide/propylene oxide=40/60, and a mass ratio of silicone/polyether=20/80.

Second Embodiment

A second embodiment in which a synthetic fiber according to the present invention is embodied will now be described. The synthetic fiber of the present embodiment includes the treatment agent of the first embodiment adhered thereto. The synthetic fiber is not particularly limited, and specific examples thereof include (1) polyethylene terephthalate, polypropylene terephthalate, polylactic acid ester, and other polyester fibers, (2) nylon 6, nylon 66, and other polyamide fibers, (3) polyacrylic, modacrylic, and other polyacrylic fibers, (4) polyethylene, polypropylene, and other polyolefin fibers, (5) a cellulose fiber, and (6) a lignin fiber.

The synthetic fiber is preferably a carbon fiber precursor that is made of resin and becomes a carbon fiber by undergoing a carbonization step described below. The resin constituting the carbon fiber precursor is not particularly limited and, examples thereof include an acrylic resin, polyethylene resin, phenol resin, cellulose resin, lignin resin, and pitch.

The proportion of the treatment agent of the first embodiment to be adhered to the synthetic fiber is not particularly limited, and the treatment agent (not including solvent) is preferably adhered such as to be 0.1% to 2% by mass and more preferably adhered such as to be 0.3% to 1.2% by mass with respect to the synthetic fiber.

The form of the treatment agent of the first embodiment when adhering the treatment agent to the fiber is, for example, an organic solvent solution or an aqueous liquid.

The method for adhering the treatment agent to the synthetic fiber may be a method of using, for example, an organic solvent solution or aqueous liquid of the treatment agent of the first embodiment to adhere by a known method such as an immersion method, a spray method, a roller method, or a guide lubricating method using a metering pump.

The method for producing carbon fibers using the treatment agent according to the present invention and the synthetic fiber with the treatment agent adhered thereto will now be described.

The method for producing carbon fibers preferably undergoes the first to third steps described below.

First step: a spinning step of spinning synthetic fibers and adhering the treatment agent of the first embodiment to the synthetic fibers.

Second step: a flame-resisting processing step of converting the synthetic fibers obtained in the first step to flame-resistant fibers in an oxidizing atmosphere of 200° C. to 300° C. and preferably 230° C. to 270° C.

Third step: a carbonization step of carbonizing the flame-resistant fibers obtained in the second step in an inert atmosphere of 300° C. to 2000° C. and preferably 300° C. to 1300° C.

The spinning step preferably further includes a wet spinning step of dissolving a resin in a solvent and spinning it into fibers, a dry and densification step of drying and densifying the wet-spun synthetic fibers, and a drawing step of drawing the dry densified synthetic fibers.

The temperature of the dry and densification step is not particularly limited, and the synthetic fibers that have undergone the wet spinning step are preferably heated, for example, at 70° C. to 200° C. The timing at which the treatment agent is adhered to the synthetic fibers is not particularly limited, and it is preferably between the wet spinning step and the dry and densification step.

The oxidizing atmosphere in the flame-resisting processing step is not particularly limited, and, for example, an air atmosphere can be used.

The inert atmosphere in the carbonization step is not particularly limited, and, for example, a nitrogen atmosphere, an argon atmosphere, or a vacuum atmosphere can be used.

The following effects can be obtained by the treatment agent and the synthetic fiber of the embodiments.

(1) The treatment agent contains the phenol amine compound and the nonionic surfactant. Therefore, when the synthetic fiber to which the treatment agent is adhered is subject to flame-resisting processing, the bundling property of the flame-resistant fiber can be improved. Also, when the flame-resistant fiber is carbonized, fluffing of the carbon fiber can be suppressed.

(2) By the treatment agent further containing the Broensted acid, the bundling property of the flame-resistant fiber can be further improved.

(3) By the treatment agent containing the epoxy compound, fluffing of the carbon fiber can be suitably suppressed when producing the carbon fiber using the synthetic fiber with the treatment agent adhered thereto.

(4) By the treatment agent containing the other silicone and the epoxy compound, fusion between the carbon fibers can be more suitably suppressed when producing the carbon fiber using the synthetic fibers with the treatment adhered thereto.

The above-described embodiments can be modified as follows. The above-described embodiments and the following modifications can be implemented upon being combined with each other within a range that is not technically inconsistent.

Although in the embodiments, the treatment agent is adhered to the synthetic fiber between the wet spinning step and the dry and densification step, there is no restriction to this aspect. The treatment agent may be adhered to the synthetic fiber between the dry and densification step and the drawing step or between the drawing step and the flame-resisting processing step.

In the embodiments, for example, the synthetic fiber does not need to be subject to the carbonization step following the flame-resisting processing step. The synthetic fiber does not need to be subject to both the flame-resisting processing step and the carbonization step is performed.

A stabilizer, an antistatic agent, a binder, an antioxidant, an ultraviolet absorber, an antifoaming agent (silicone compound), and other ingredients that are ordinarily used in the treatment agent for quality maintenance of the treatment agent may further be blended in the treatment agent of the embodiments within a range that does not impair the effects of the present invention.

EXAMPLES

Examples will now be given below to describe the features and the effects of the present invention more specifically, but the present invention is not limited to these examples. In the following description of working examples and comparative examples, parts means parts by mass and % means % by mass.

Experimental Part 1 (Preparation of Synthetic Fiber Treatment Agents)

Example 1

A solution (A-1) of phenol amine compound containing a phenol amine compound (a1-1) and a diluent (a2-1) shown in Table 1 at respective blending ratios of 70 parts and 30 parts was prepared by a method described below.

<Solution (A-1) of Phenol Amine Compound>

First, 800 parts (1 equivalent) of a phenol modified with a polybutenyl group with a number average molecular weight of a polybutene portion being 1500, 52 parts (0.7 equivalents) of triethylenetetramine, and 368 parts of a mineral oil of 100 Redwood seconds were mixed. After dripping 30 parts of a 50% formaldehyde aqueous solution (corresponding to 15 parts of formaldehyde; 1 equivalent) over a period of 1 hour into the mixture obtained, a reaction was made to occur at 100° C. for 3 hours under a nitrogen gas flow. The temperature was raised to 200° C., and unreacted material and formed water were removed under reduced pressure. Thereafter, the temperature was decreased and filtration was performed to prepare the solution (A-1) of phenol amine compound solution.

Solutions (A-2) to (A-12) of phenyl amine compounds were prepared by the following methods.

<Solution (A-2) of Phenol Amine Compound>

100 parts of the solution (A-1) of phenol amine compound were made to react with 1.1 parts of boric acid to prepare a solution (A-2) of phenol amine compound with a boron content of 0.2% by mass.

<Solution (A-3) of Phenol Amine Compound>

730 parts (1 equivalent) of a phenol modified with a polybutenyl group with a number average molecular weight of a polybutene portion being 1200, 58 parts (1 equivalent) of diethylenetriamine, and 530 parts of a liquid paraffin of 80 Redwood seconds were mixed. After dripping 34 parts of a 50% formaldehyde aqueous solution (corresponding to 17 parts of formaldehyde; 1 equivalent) over a period of 1 hour into the mixture obtained, a reaction was made to occur at 100° C. for 3 hours under a nitrogen gas flow. The temperature was raised to 200° C., and unreacted material and formed water were removed under reduced pressure. Thereafter, the temperature was decreased and filtration was performed to prepare a solution (A-3) of phenol amine compound.

<Solution (A-4) of Phenol Amine Compound>

800 parts (1 equivalent) of a phenol modified with a polybutenyl group with a number average molecular weight of a polybutene portion being 600, 102 parts (0.6 equivalents) of triethylenetetramine, and 916 parts of a mineral oil of 150 Redwood seconds were mixed. After dripping 70 parts of a 50% formaldehyde aqueous solution (corresponding to 35 parts of formaldehyde; 1 equivalent) over a period of 1 hour into the mixture obtained, a reaction was made to occur at 100° C. for 3 hours under a nitrogen gas flow. The temperature was raised to 200° C., and unreacted material and formed water were removed under reduced pressure. Thereafter, the temperature was decreased and filtration was performed to prepare a solution (A-4) of phenol amine compound.

<Solution (A-5) of Phenol Amine Compound>

800 parts (1 equivalent) of a phenol modified with a polybutenyl group with a number average molecular weight of a polybutene portion being 1500, 47 parts (0.5 equivalents) of tripropylenetetramine, and 213 parts of a liquid paraffin of 100 Redwood seconds were mixed. After dripping 30 parts of a 50% formaldehyde aqueous solution (corresponding to 15 parts of formaldehyde; 1 equivalent) over a period of 1 hour into the mixture obtained, a reaction was made to occur at 100° C. for 3 hours under a nitrogen gas flow. The temperature was raised to 200° C., and unreacted material and formed water were removed under reduced pressure. Thereafter, the temperature was decreased and filtration was performed to prepare a solution (A-5) of phenol amine compound.

<Solution (A-6) of Phenol Amine Compound>

800 parts (1 equivalent) of a phenol modified with a polybutenyl group with a number average molecular weight of a polybutene portion being 1500, 66 parts (0.9 equivalents) of triethylenetetramine, and 872 parts of a mineral oil of 100 Redwood seconds were mixed. After dripping 30 parts of a 50% formaldehyde aqueous solution (corresponding to 15 parts of formaldehyde; 1 equivalent) over a period of 1 hour into the mixture obtained, a reaction was made to occur at 100° C. for 3 hours under a nitrogen gas flow. The temperature was raised to 200° C., and unreacted material and formed water were removed under reduced pressure. Thereafter, the temperature was decreased and filtration was performed to prepare a solution (A-6) of phenol amine compound.

<Solution (A-7) of Phenol Amine Compound>

100 parts of the solution (A-6) of phenol amine compound were made to react with 5.7 parts of boric acid to prepare a solution (A-7) of phenol amine compound with a boron content of 1.0% by mass.

<Solution (A-8) of Phenol Amine Compound>

800 parts (1 equivalent) of a phenol modified with a polyisobutenyl group with a number average molecular weight of a polyisobutylene portion being 900, 130 parts (1.1 equivalents) of triethylenetetramine, and 1410 parts of a mineral oil of 190 Redwood seconds were mixed. After dripping 150 parts of a 50% formaldehyde aqueous solution (corresponding to 75 parts of formaldehyde; 3.1 equivalents) over a period of 1 hour into the mixture obtained, a reaction was made to occur at 100° C. for 3 hours under a nitrogen gas flow. The temperature was raised to 200° C., and unreacted material and formed water were removed under reduced pressure. Thereafter, the temperature was decreased and filtration was performed to prepare a solution (A-8) of phenol amine compound.

<Solution (A-9) of Phenol Amine Compound>

800 parts (1 equivalent) of a phenol modified with a polybutenyl group with a number average molecular weight of a polybutene portion being 600, 175 parts (0.8 equivalents) of tetraethylenepentamine, and 423 parts of a mineral oil of 100 Redwood seconds were mixed. After dripping 62 parts of a 50% formaldehyde aqueous solution (corresponding to 31 parts of formaldehyde; 0.9 equivalents) over a period of 1 hour into the mixture obtained, a reaction was made to occur at 100° C. for 3 hours under a nitrogen gas flow. The temperature was raised to 200° C., and unreacted material and formed water were removed under reduced pressure. Thereafter, the temperature was decreased and filtration was performed to prepare a solution (A-9) of phenol amine compound.

<Solution (A-10) of Phenol Amine Compound>

800 parts (1 equivalent) of a phenol modified with a polybutenyl group with a number average molecular weight of a polybutene portion being 1000, 31 parts (0.7 equivalents) of ethylenediamine, and 840 parts of a mineral oil of 120 Redwood seconds were mixed. After dripping 44 parts of a 50% formaldehyde aqueous solution (corresponding to 22 parts of formaldehyde; 1 equivalent) over a period of 1 hour into the mixture obtained, a reaction was made to occur at 100° C. for 3 hours under a nitrogen gas flow. The temperature was raised to 200° C., and unreacted material and formed water were removed under reduced pressure. Thereafter, the temperature was decreased and filtration was performed to prepare a solution (A-10) of phenol amine compound.

<Solution (A-11) of Phenol Amine Compound>

800 parts (1 equivalent) of a phenol modified with a polypropenyl group with a number average molecular weight of a polypropylene portion being 1500, 55 parts (0.4 equivalents) of tributylenetetramine, and 863 parts of a mineral oil of 120 Redwood seconds were mixed. After dripping 30 parts of a 50% formaldehyde aqueous solution (corresponding to 15 parts of formaldehyde; 1 equivalent) over a period of 1 hour into the mixture obtained, a reaction was made to occur at 100° C. for 3 hours under a nitrogen gas flow. The temperature was raised to 200° C., and unreacted material and formed water were removed under reduced pressure. Thereafter, the temperature was decreased and filtration was performed to prepare a solution (A-11) of phenol amine compound.

<Solution (A-12) of Phenol Amine Compound>

800 parts (1 equivalent) of a phenol modified with an octyl group, 260 parts (0.7 equivalents) of diethylenetriamine, and 871 parts of a mineral oil of 120 Redwood seconds were mixed. After dripping 276 parts of a 50% formaldehyde aqueous solution (corresponding to 108 parts of formaldehyde; 1 equivalent) over a period of 1 hour into the mixture obtained, a reaction was made to occur at 100° C. for 3 hours under a nitrogen gas flow. The temperature was raised to 200° C., and unreacted material and formed water were removed under reduced pressure. Thereafter, the temperature was decreased and filtration was performed to prepare a solution (A-12) of phenol amine compound.

The types and contents of the phenol amine compounds and the types and contents of the diluents are as shown in the "Phenol amine compound" column and the "Diluent" column, respectively, of Table 1.

TABLE 1

| Type of solution of phenol amine | Phenol amine compound | | Diluent | |
|---|---|---|---|---|
| compound | Symbol | % by mass | Symbol | % by mass |
| A-1 | a1-1 | 70 | a2-1 | 30 |
| A-2 | a1-2 | 70 | a2-1 | 30 |
| A-3 | a1-3 | 60 | a2-2 | 40 |
| A-4 | a1-4 | 50 | a2-3 | 50 |
| A-5 | a1-5 | 80 | a2-4 | 20 |
| A-6 | a1-6 | 50 | a2-5 | 50 |
| A-7 | a1-7 | 53 | a2-5 | 47 |
| A-8 | a1-8 | 40 | a2-6 | 60 |
| A-9 | a1-9 | 70 | a2-1 | 30 |
| A-10 | a1-10 | 50 | a2-5 | 50 |
| A-11 | a1-11 | 50 | a2-5 | 50 |
| A-12 | a1-12 | 80 | a2-5 | 20 |

(Phenol Amine Compounds)

a1-1: compound obtained by reacting a phenol modified with a polybutenyl group with a number average molecular weight of a polybutene portion being 1500, formaldehyde, and triethylenetetramine.

a1-2: compound obtained by reacting a phenol modified with a polybutenyl group with a number average molecular weight of a polybutene portion being 1500, formaldehyde, and triethylenetetramine and then reacting the resultant with boron (boron content: 0.2% by mass).

a1-3: compound obtained by reacting a phenol modified with a polybutenyl group with a number average molecular weight of a polybutene portion being 1200, formaldehyde, and diethylenetriamine.

a1-4: compound obtained by reacting a phenol modified with a polybutenyl group with a number average molecular weight of a polybutene portion being 600, formaldehyde, and triethylenetetramine.

a1-5: compound obtained by reacting a phenol modified with a polybutenyl group with a number average molecular weight of a polybutene portion being 1500, formaldehyde, and tripropylenetetramine.

a1-6: compound obtained by reacting a phenol modified with a polybutenyl group with a number average molecular weight of a polybutene portion being 1500, formaldehyde, and triethylenetetramine.

a1-7: compound obtained by reacting a phenol modified with a polybutenyl group with a number average molecular weight of a polybutene portion being 1500, formaldehyde, and triethylenetetramine and then reacting the resultant with boron (boron content: 1.0% by mass).

a1-8: compound obtained by reacting a phenol modified with a polyisobutenyl group with a number average molecular weight of a polyisobutylene portion being 900, formaldehyde, and triethylenetetramine.

a1-9: compound obtained by reacting a phenol modified with a polybutenyl group with a number average molecular weight of a polybutene portion being 600, formaldehyde, and tetraethylenepentamine.

a1-10: compound obtained by reacting a phenol modified with a polybutenyl group with a number average molecular weight of a polybutene portion being 1000, formaldehyde, and ethylenediamine.

a1-11: compound obtained by reacting a phenol modified with a polypropenyl group with a number average molecular weight of a polypropylene portion being 1500, formaldehyde, and tributylenetetramine.

a1-12: compound obtained by reacting a phenol modified with an octyl group, formaldehyde, and diethylenetriamine.

(Diluents)

a2-1: Mineral oil (viscosity as measured by a Redwood viscometer of 100 seconds)

a2-2: Liquid paraffin (viscosity as measured by a Redwood viscometer of 80 seconds)

a2-3: Mineral oil (viscosity as measured by a Redwood viscometer of 150 seconds)

a2-4: Liquid paraffin (viscosity as measured by a Redwood viscometer of 100 seconds)

a2-5: Mineral oil (viscosity as measured by a Redwood viscometer of 120 seconds)

a2-6: Mineral oil (viscosity as measured by a Redwood viscometer of 190 seconds)

Next, respective ingredients shown in Table 2 were used and added to a beaker such that there were 60 parts of the solution (A-1) of phenol amine compound, 20 parts of a nonionic surfactant (B1-1), 0.5 parts of a Broensted acid (C-1), 7.5 parts of an epoxy compound (D-1), 10 parts of another silicone (E-1), and 2 parts of another compound. These were stirred well to prepare a synthetic fiber treatment agent.

Examples 2 to 26 and Comparative Examples 1 to 3

Respective solutions of phenol amine compounds of Examples 2 to 26 and Comparative Examples 1 to 3 were prepared using respective ingredients shown in Tables 1 and 2 and by the same method as Example 1. The type and content of the solution of phenol amine compound, the type and content of the nonionic surfactant, the type and content of the Broensted acid, the type and content of the epoxy compound, the type and content of the other silicone, the type and content of the other compound, and a mass ratio of the succinimide compound and the nonionic surfactant in the treatment agent of each example are as respectively indicated in the "Solution of phenol amine compound" column, the "Nonionic surfactant" column, the "Broensted acid" column, the "Epoxy compound" column, the "Other silicone" column, the "Other compound" column, and the "Succinimide compound/nonionic surfactant" column of Table 2.

TABLE 2

| | Solution of phenol amine compound | | Nonionic surfactant | | Broensted acid | | Epoxy compound | | Other silicone |
|---|---|---|---|---|---|---|---|---|---|
| | Symbol | Parts | Symbol | Parts | Symbol | Parts | Symbol | Parts | Symbol |
| Example 1 | A-1 | 60 | B1-1 | 20 | C-1 | 0.5 | D-1 | 7.5 | E-1 |
| Example 2 | A-1 | 30 | B1-1 | 20 | C-1 | 0.5 | D-1 | 7.5 | E-1 |
| | A-2 | 30 | | | | | | | |
| Example 3 | A-2 | 40 | B1-2 | 30 | C-2 | 5 | D-2 | 9 | E-2 |
| Example 4 | A-3 | 23 | B1-3 | 25 | C-3 | 2 | D-3 | 25 | E-3 |
| Example 5 | A-4 | 75 | B1-4 | 12 | C-5 | 3 | D-5 | 5 | E-4 |
| Example 6 | A-5 | 10 | B1-5 | 14 | C-4 | 3 | D-4 | 3 | E-5 |
| Example 7 | A-6 | 70 | B1-6 | 15 | C-1 | 1 | D-6 | 9 | E-6 |
| | | | | | C-6 | 2 | | | |
| Example 8 | A-7 | 57.3 | B2-1 | 27.7 | C-7 | 1 | D-1 | 9 | E-1 |
| Example 9 | A-8 | 15 | B2-2 | 70 | C-8 | 2 | D-2 | 6 | E-2 |
| Example 10 | A-9 | 42.9 | B2-3 | 30.1 | C-9 | 2 | D-3 | 10 | E-3 |
| | | | | | | | D-5 | 5 | |
| Example 11 | A-10 | 40 | B1-1 | 21 | C-3 | 1 | D-4 | 15 | E-4 |
| Example 12 | A-11 | 30 | B1-5 | 40 | C-4 | 2 | D-1 | 15 | E-5 |
| Example 13 | A-12 | 50 | B1-2 | 21 | C-3 | 1 | D-4 | 5 | E-6 |
| Example 14 | A-1 | 33 | B1-7 | 25 | C-3 | 1 | D-3 | 11 | — |
| | A-2 | 30 | | | | | | | |
| Example 15 | A-1 | 70 | B1-6 | 18 | C-2 | 2 | D-1 | 10 | — |
| Example 16 | A-3 | 50 | B1-2 | 30 | C-9 | 0.5 | D-5 | 10 | — |
| | | | | | | | D-6 | 9.5 | |
| Example 17 | A-4 | 34.8 | B1-3 | 25 | C-1 | 0.2 | D-7 | 10 | E-1 |
| Example 18 | A-5 | 5 | B1-5 | 15 | C-5 | 1 | D-8 | 1 | E-2 |
| Example 19 | A-6 | 60 | B2-1 | 22 | C-6 | 1 | D-9 | 17 | — |
| Example 20 | A-7 | 20 | B2-2 | 32 | C-2 | 7 | D-10 | 20 | — |
| | | | | | C-7 | 1 | | | |
| Example 21 | A-8 | 44 | B2-3 | 10 | C-10 | 1 | D-11 | 45 | — |
| Example 22 | A-9 | 75 | B1-8 | 14.8 | C-11 | 0.2 | — | — | E-3 |
| Example 23 | A-2 | 54 | B1-8 | 25 | C-2 | 1 | — | — | E-2 |
| | | | | | | | | | E-6 |
| Example 24 | A-4 | 30 | B1-8 | 69 | C-4 | 1 | — | — | — |
| Example 25 | A-1 | 50 | B1-9 | 30 | — | — | — | — | E-4 |
| Example 26 | A-12 | 70 | B1-9 | 30 | — | — | — | — | — |
| Comparative Example 1 | — | — | B1-1 | 13 | C-1 | — | — | — | E-2 |
| Comparative Example 2 | — | — | B1-6 | 28 | — | — | — | — | — |
| Comparative Example 3 | — | — | B1-1 | 25 | C-7 | — | — | — | E-3 |

| | Other silicone | Other compound | | Phenol amine compound/ Nonionic surfactant | Evaluation results | | | |
|---|---|---|---|---|---|---|---|---|
| | Parts | Symbol | Parts | Ratio | Flame-resistant bundling property | Fusion | Strength | Fluffing |
| Example 1 | 10 | F-3 | 2 | 67.7/32.3 | ◎ | ◎ | ◎◎ | ◎◎ |
| Example 2 | 10 | F-3 | 2 | 67.7/32.3 | ◎ | ◎ | ◎◎ | ◎◎ |
| Example 3 | 15 | F-4 | 1 | 48.3/51.7 | ◎ | ◎ | ◎◎ | ◎◎ |
| Example 4 | 25 | — | — | 35.6/64.4 | ◎ | ◎ | ◎◎ | ◎◎ |
| Example 5 | 5 | — | — | 75.8/24.2 | ◎ | ◎ | ◎◎ | ◎◎ |
| Example 6 | 70 | — | — | 36.4/63.6 | ◎ | ◎ | ◎◎ | ◎◎ |
| Example 7 | 2 | F-3 | 1 | 70/30 | ◎ | ◎ | ◎◎ | ◎◎ |
| Example 8 | 5 | — | — | 52/48 | ◎ | ◎ | ◎◎ | ◎◎ |
| Example 9 | 7 | — | — | 7.9/92.1 | ◎ | ◎ | ◎◎ | ◎◎ |
| Example 10 | 10 | — | — | 49.9/50.1 | ◎ | ◎ | ◎◎ | ◎◎ |
| Example 11 | 20 | F-4 | 3 | 48.8/51.2 | ◎ | ◎ | ◎◎ | ◎◎ |
| Example 12 | 13 | — | — | 27.3/72.7 | ◎ | ◎ | ◎◎ | ◎◎ |
| Example 13 | 20 | F-3 | 3 | 65.6/34.4 | ◎ | ◎ | ◎◎ | ◎◎ |
| Example 14 | — | — | — | 63.8/36.2 | ◎ | ◎ | ◎ | ◎◎ |
| Example 15 | — | — | — | 73.1/26.9 | ◎ | ◎ | ◎ | ◎◎ |
| Example 16 | — | — | — | 50/50 | ◎ | ◎ | ◎ | ◎◎ |
| Example 17 | 30 | — | — | 41/59 | ◎ | ◎ | ◎◎ | ◎ |
| Example 18 | 78 | — | — | 21.1/78.9 | ◎ | ◎ | ◎◎ | ◎ |
| Example 19 | — | — | — | 57.7/42.3 | ◎ | ◎ | ◎ | ◎ |
| Example 20 | — | F-5 | 20 | 25.6/74.4 | ◎ | ◎ | ◎ | ◎ |
| Example 21 | — | — | — | 63.8/36.2 | ◎ | ◎ | ◎ | ◎ |
| Example 22 | 10 | — | — | 78/22 | ◎ | ◎ | ◎ | ○ |
| Example 23 | 15 | — | — | 60.2/39.8 | ◎ | ◎ | ◎ | ○ |
| | 5 | | | | | | | |

TABLE 2-continued

| | | | | | | | | |
|---|---|---|---|---|---|---|---|---|
| Example 24 | — | — | — | 17.9/82.1 | ◎ | ○ | ○ | ○ |
| Example 25 | 20 | — | — | 53.8/46.2 | ○ | ◎ | ◎ | ○ |
| Example 26 | — | — | — | 65.1/34.9 | ○ | ○ | ○ | ○ |
| Comparative Example 1 | 78 | F-1 | 8 | 0/100 | X | ○ | ○ | X |
| Comparative Example 2 | — | F-2<br>F-3 | 70<br>2 | 0/100 | ○ | X | X | X |
| Comparative Example 3 | 72 | F-3 | 2 | 0/100 | X | ○ | ◎ | X |

Details of the respective ingredients B1-1 to B1-9, B2-1 to B2-3, C-1 to C-11, D-1 to D-11, E-1 to E-6, and F-1 to F-5 indicated in the symbol columns of Table 2 are as follows.

(Nonionic Surfactants)

B1-1: compound in which 9 moles of ethylene oxide are added to 1 mole of dodecyl alcohol B1-2: compound in which 12 moles of ethylene oxide are added to 1 mole of isododecyl alcohol B1-3: compound in which 7 moles of ethylene oxide are added to 1 mole of tetradecyl alcohol B1-4: compound in which 7 moles of ethylene oxide are added to 1 mole of tetradecyl alcohol B1-5: compound in which 15 moles of ethylene oxide are added to 1 mole of pentadecyl alcohol B1-6: compound in which 15 moles of ethylene oxide are added and thereafter 18 moles of propylene oxide are added to 1 mole of tetradecyl alcohol B1-7: compound in which 9 moles of ethylene oxide are added to 1 mole of secondary tridecyl alcohol B1-8: compound in which 2 moles of ethylene oxide and 6 moles of propylene oxide are randomly added to 1 mole of dodecyl alcohol B1-9: compound in which 15 moles of ethylene oxide and 9 moles of propylene oxide are added to 1 mole of tristyrenated phenol B2-1: compound in which 4 moles of ethylene oxide are added to 1 mole of dodecylamine B2-2: compound in which 8 moles of ethylene oxide are added to 1 mole of dodecylamine B2-3: compound in which 15 moles of ethylene oxide are added to 1 mole of octadecylamine (Broensted Acids)

C-1: acetic acid

C-2: polyoxyethylene (n=10) lauryl ether acetic acid

C-3: polyoxyethylene (n=4.5) lauryl ether acetic acid

C-4: oleoyl sarcosinate

C-5: lauroyl sarcosinate

C-6: phosphoric acid ester of a 5 mole ethylene oxide adduct of tridecyl alcohol C-7: hexadecyl phosphoric acid ester C-8: lactic acid C-9: citric acid C-10: phosphoric acid C-11: dodecyl benzenesulfonic acid (Epoxy Compounds)

D-1: side-chain type alicyclic epoxy-modified silicone with a kinematic viscosity at 25° C. of 6000 $mm^2/s$ and an equivalent weight of 3700 g/mol D-2: side-chain type glycidyl epoxy-modified silicone with a kinematic viscosity at 25° C. of 8000 $mm^2/s$ and an equivalent weight of 3300 g/mol D-3: dual-end type glycidyl epoxy-modified silicone with a kinematic viscosity at 25° C. of 120 $mm^2/s$ and an equivalent weight of 2700 g/mol D-4: side-chain type glycidyl epoxy polyether-modified silicone with a kinematic viscosity at 25° C. of 2800 $mm^2/s$ and an equivalent weight of 2800 g/mol D-5: side-chain type alicyclic epoxy-modified silicone with a kinematic viscosity at 25° C. of 5000 $mm^2/s$ and an equivalent weight of 4200 g/mol D-6: side-chain type glycidyl epoxy polyether-modified silicone with a kinematic viscosity at 25° C. of 3100 $mm^2/s$ and an equivalent weight of 10200 g/mol D-7: bisphenol A diglycidyl ether (average molecular weight: 370)

D-8: bisphenol A diglycidyl ether (average molecular weight: 470)

D-9: bisphenol F diglycidyl ether (average molecular weight: 340)

D-10: tetraglycidyl diaminediphenylmethane

D-11: glycidyl-etherified product of polyglycerin (average molecular weight: 1000)

(Other Silicones)

E-1: amino-modified silicone of a diamine type with a kinematic viscosity at 25° C. of 250 $mm^2/s$ and an equivalent weight of 7600 g/mol E-2: amino-modified silicone of a diamine type with a kinematic viscosity at 25° C. of 1300 $mm^2/s$ and an equivalent weight of 1700 g/mol E-3: amino-modified silicone of a monoamine type with a kinematic viscosity at 25° C. of 1700 $mm^2/s$ and an equivalent weight of 3800 g/mol E-4: amino-modified silicone of a diamine type with a kinematic viscosity at 25° C. of 80 $mm^2/s$ and an equivalent weight of 4000 g/mol E-5: dimethyl silicone with a kinematic viscosity at 25° C. of 5000 $mm^2/s$ E-6: polyether-modified silicone with a kinematic viscosity at 25° C. of 1700 $mm^2/s$, ethylene oxide/propylene oxide=40/60, and a mass ratio of silicone/polyether=20/80

(Other Compounds)

F-1: compound in which 3-aminopropyl groups are added to both terminals of a polyethylene glycol with a molecular weight of 600

F-2: didodecyl ester of a 2 mole ethylene oxide adduct of bisphenol A

F-3: ethyl sulfuric acid salt of 1-ethyl-2-(heptadecenyl)-4,5-dihydro-3-(2-hydroxyethyl)-1H-imidazolinium F-4: trimethyloctylammonium dimethyl phosphate F-5: isotridecyl isostearate Experimental Part 2 (Production of Synthetic Fibers and Carbon Fibers)

Synthetic fibers and carbon fibers were produced using the synthetic fiber treatment agents prepared in Experimental Part 1.

First, as the first step, an acrylic resin was wet spun. Specifically, a copolymer of 1.80 limiting viscosity constituted of 95% by mass acrylonitrile, 3.5% by mass methyl acrylate, and 1.5% by mass methacrylic acid was dissolved in dimethylacetamide (DMAC) to prepare a spinning dope with a polymer concentration of 21.0% by mass and a viscosity at 60° C. of 500 poise. The spinning dope was discharged at a draft ratio of 0.8 from a spinneret with 12,000 holes of 0.075 mm hole diameter (inner diameter) into a coagulation bath of a 70% by mass aqueous solution of DMAC maintained at a spinning bath temperature of 35° C.

The coagulated yarn was drawn by 5 times at the same time as being desolvated in a rinse tank to prepare acrylic fiber strands (raw material fibers) in a water-swollen state. To these acrylic fiber strands, the synthetic fiber treatment agents prepared in Experimental Part 1 were each applied such that a solids adhesion amount would be 1% by mass (not including the solvent). Application of each synthetic fiber treatment agent was performed by an immersion method using a 4% ion exchanged water solution of the synthetic fiber treatment agent. Thereafter, the acrylic fiber strands were subject to dry and densification by a heating roller set at 130° C., further subject to drawing by 1.7 times between heating rollers set at 170° C., and thereafter wound around a spool using a winding device.

Next, as the second step, yarns were unwound from the wound synthetic fibers and, after being subject to flame-resisting processing for 1 hour under an air atmosphere in a flame-resisting processing furnace having a temperature gradient of 230° C. to 270° C., were wound around a spool via a conveying roller to obtain flame-resistant yarns (flame-resistant fibers).

Next, as the third step, yarns were unwound from the wound flame-resistant yarns and, after conversion to carbon fibers by baking under a nitrogen atmosphere in a carbonizing furnace having a temperature gradient of 300° C. to 1300° C., were wound around a spool to obtain the carbon fibers.

Experimental Part 3 (Evaluation)

Regarding each of the treatment agents of Examples 1 to 26 and Comparative Examples 1 to 3, the bundling property of the flame-resistant fibers prepared using the synthetic fibers with the treatment agent adhered thereto, occurrence/non-occurrence of fusion between the carbon fibers, the strength of the carbon fibers, and occurrence/non-occurrence of fluffing of the carbon fibers were respectively evaluated by procedures described below.

(Flame-Resistant Bundling Property)

The bundling state when the fibers subject to the flame-resisting processing passed through the conveying roller in the second step of Experimental Part 2 was checked visually and the bundling property was evaluated based on criteria given below. The results of the evaluation are shown in the "Flame-resistant bundling property" column of Table 2.

Evaluation criteria of bundling property of flame-resistant fibers

- ◎ (satisfactory): The fibers are bundled, a tow width is relatively narrow, and the tow width is constant.
- ○ (fair): Although the fibers are bundled, the tow width is not constant.
- x (poor): The fibers are not bundled, there are spaces inside fiber bundles, and the tow width is wide.

(Fusion)

The carbon fibers obtained in the third step of Experimental Part 2 were cut to a length of 10 mm and dispersed in an aqueous solution of polyoxyethylene (10) lauryl ether. After stirring for 10 minutes, a dispersion state of the fibers was checked visually and fusion was evaluated based on criteria given below. The results of the evaluation are shown in the "Fusion" column of Table 2.

- ◎ (satisfactory): The fibers are completely dispersed uniformly and presence of short fiber bundles is not seen at all.
- ○ (fair): Although the fibers are generally dispersed uniformly, the presence of short fiber bundles is clearly seen.
- x (poor): The dispersion state of the fibers is nonuniform and the presence of short fiber bundles is seen across the entirety.

(Strength)

The carbon fibers obtained in the third step of Experimental Part 2 were used to measure a strength of the carbon fibers in accordance with JIS R7606 (corresponding international standard: ISO 11566:1996). The strength of the carbon fibers was evaluated based on criteria given below. The results of the evaluation are shown in the "Strength" column of Table 2.

Evaluation criteria of strength

- ◎◎ (excellent): The strength is not less than 4.5 GPa.
- ◎ (satisfactory): The strength is not less than 4.0 GPa but less than 4.5 GPa.
- ○ (fair): The strength is not less than 3.5 GPa but less than 4.0 GPa.
- x (poor): The strength is less than 3.5 GPa.

(Fluffing)

In the third step of Experimental Part 2, the carbon fibers wound around the spool were observed visually and the number of fluffs per 10 minutes was evaluated based on criteria given below. The results of the evaluation are shown in the "Fluffing" column of Table 2.

Evaluation criteria of fluffing

- ◎◎ (excellent): The number of fluffs is less than 10.
- ◎ (satisfactory): The number of fluffs is not less than 10 but less than 30.
- ○ (fair): The number of fluffs is not less than 30 but less than 50.
- x (poor): The number of fluffs is not less than 50.

Based on the results of Table 2, the present invention succeeds in suitably improving the bundling property of flame-resistant fibers. Also, with the carbon fiber produced using the synthetic fiber with the synthetic fiber treatment agent of the present invention adhered thereto, fusion between fibers is suppressed. Also, the strength is improved and fluffing is suppressed.

The present disclosure also encompasses the following embodiments.

Additional Embodiment 1

A synthetic fiber treatment agent for treating a synthetic fiber, comprising a phenol amine compound and a nonionic surfactant.

Additional Embodiment 2

The synthetic fiber treatment agent according to additional embodiment 1, wherein the phenol amine compound includes a compound formed from a phenol derivative, formaldehyde, and a polyamine compound or a compound obtained by reacting therewith a boron-containing compound, and the phenol derivative is a phenol in which a hydrocarbon group with a number average molecular weight of not less than 100 and not more than 2000.

Additional Embodiment 3

The synthetic fiber treatment agent according to additional embodiment 1 or 2, wherein the nonionic surfactant includes a compound in which an alkylene oxide with not less than 2 and not more than 4 carbon atoms is added at a ratio of not less than 1 mole and not more than 50 moles in total to 1 mole of a monohydric alcohol or alkylamine with not less than 4 and not more than 30 carbon atoms.

Additional Embodiment 4

The synthetic fiber treatment agent according to any one of additional embodiments 1 to 3, wherein the mass ratio of the phenol amine compound and the nonionic surfactant is such that phenol amine compound/nonionic surfactant is not less than 5/95 and not more than 95/5.

Additional Embodiment 5

The synthetic fiber treatment agent according to any one of additional embodiments 1 to 4, further comprising a Broensted acid.

Additional Embodiment 6

The synthetic fiber treatment agent according to any one of additional embodiments 1 to 5, further comprising an epoxy compound.

Additional Embodiment 7

The synthetic fiber treatment agent according to additional embodiment 6, wherein the epoxy compound includes at least one selected from the group consisting of an epoxy-modified silicone and an epoxy and polyether-modified silicone.

Additional Embodiment 8

The synthetic fiber treatment agent according to any one of additional embodiments 1 to 7, further comprising at least one selected from the group consisting of an amino-modified silicone, a dimethyl silicone, and a polyether-modified silicone.

Additional Embodiment 9

The synthetic fiber treatment agent according to any one of additional embodiments 1 to 8, wherein the synthetic fiber is a carbon fiber precursor.

Additional Embodiment 10

A synthetic fiber having the synthetic fiber treatment agent according to any one of additional embodiments 1 to 9 adhered thereto.

The invention claimed is:

1. A synthetic fiber treatment agent for treating a synthetic fiber, comprising a phenol amine compound and a nonionic surfactant, wherein the phenol amine compound is at least one selected from the group consisting of a compound formed from a phenol derivative, formaldehyde, and a polyamine compound and a compound obtained by reacting a boron-containing compound with a compound formed from a phenol derivative, formaldehyde, and a polyamine compound, and the phenol derivative is a phenol in which a hydrocarbon group with a number average molecular weight of not less than 100 and not more than 2000 is modified.

2. The synthetic fiber treatment agent according to claim 1, wherein the nonionic surfactant includes at least one selected from the group consisting of a compound in which an alkylene oxide with not less than 2 and not more than 4 carbon atoms is added at a ratio of not less than 1 mole and not more than 50 moles in total to 1 mole of a monohydric alcohol with not less than 4 and not more than 30 carbon atoms and a compound in which an alkylene oxide with not less than 2 and not more than 4 carbon atoms is added at a ratio of not less than 1 mole and not more than 50 moles in total to 1 mole of an alkylamine with not less than 4 and not more than 30 carbon atoms.

3. The synthetic fiber treatment agent according to claim 1, wherein the mass ratio of the phenol amine compound and the nonionic surfactant is such that phenol amine compound/nonionic surfactant is not less than 5/95 and not more than 95/5.

4. The synthetic fiber treatment agent according to claim 1, further comprising a Broensted acid.

5. The synthetic fiber treatment agent according to claim 1, further comprising an epoxy compound.

6. The synthetic fiber treatment agent according to claim 5, wherein the epoxy compound includes at least one selected from the group consisting of an epoxy-modified silicone and an epoxy and polyether-modified silicone.

7. The synthetic fiber treatment agent according to claim 1, further comprising at least one selected from the group consisting of an amino-modified silicone, a dimethyl silicone, and a polyether-modified silicone.

8. The synthetic fiber treatment agent according to claim 1, wherein the synthetic fiber is a carbon fiber precursor.

9. A synthetic fiber having the synthetic fiber treatment agent according to claim 1 adhered thereto.

* * * * *